US011364644B2

(12) United States Patent
Rus

(10) Patent No.: US 11,364,644 B2
(45) Date of Patent: Jun. 21, 2022

(54) UTILITY KNIFE

(71) Applicant: Garland Industries, Inc., Cleveland, OH (US)

(72) Inventor: Melissa Rus, Cleveland, OH (US)

(73) Assignee: GARLAND INDUSTRIES, INC., Cleveland, OH (US)

( * ) Notice: Subject to any disclaimer, the term of this patent is extended or adjusted under 35 U.S.C. 154(b) by 10 days.

(21) Appl. No.: 16/693,862

(22) Filed: Nov. 25, 2019

(65) Prior Publication Data

US 2020/0086512 A1 Mar. 19, 2020

Related U.S. Application Data

(60) Division of application No. 15/981,240, filed on May 16, 2018, now abandoned, and a continuation-in-part of application No. 29/604,206, filed on May 16, 2017, now abandoned.

(60) Provisional application No. 62/506,775, filed on May 16, 2017.

(51) Int. Cl.

| | |
|---|---|
| ***B26B 5/00*** | (2006.01) |
| ***B26B 29/02*** | (2006.01) |
| *B26B 1/10* | (2006.01) |

(52) U.S. Cl.

CPC ..... *B26B 5/006* (2013.01); *B26B 29/02* (2013.01); *B26B 1/10* (2013.01)

(58) Field of Classification Search

CPC ..... B26B 5/00; B26B 5/006; B26B 29/02; B26B 29/025; B26B 3/00; B26B 3/06; B26B 3/08; B26B 21/24; B26B 27/005; B26B 1/10

USPC ..... 30/246, 280, 294, 314, 317, 162

See application file for complete search history.

(56) References Cited

U.S. PATENT DOCUMENTS

| | | | | |
|---|---|---|---|---|
| 2,810,194 | A | 10/1957 | Unsinger | |
| 3,380,159 | A | 4/1968 | Winston | |
| 4,662,070 | A | 5/1987 | Reddig et al. | |
| 4,713,884 | A | 12/1987 | Dunnagan | |
| 5,386,632 | A | 2/1995 | Schmidt | |
| 5,404,645 | A | 4/1995 | Janser | |
| 5,737,842 | A * | 4/1998 | Freedman | B26B 3/00 30/280 |
| 5,797,188 | A | 8/1998 | Gilbert | |
| 5,806,189 | A * | 9/1998 | Bailey | B26B 5/001 30/125 |
| 5,940,970 | A | 8/1999 | D'Ambro, Sr. | |

(Continued)

FOREIGN PATENT DOCUMENTS

DE 202016100807 U1 2/2016

*Primary Examiner* — Ghassem Alie
*Assistant Examiner* — Nhat Chieu Q Do
(74) *Attorney, Agent, or Firm* — Ulmer & Berne, LLP; Brian E Turung

(57) ABSTRACT

A utility knife and methods for using the same are disclosed. The utility knife includes a handle portion, a head unit attached to the handle portion, and a blade attached to the head unit. The handle portion is made of two parts jointed together by a hinged connection arrangement. A blade support component is also included which orients the blade in perpendicular relation to a central axis of the handle. The exemplary utility knife can safely be used in many applications with a design configured to help prevent user contact with the blade's cutting edge or edges.

9 Claims, 7 Drawing Sheets

(56) References Cited

U.S. PATENT DOCUMENTS

| | | | | |
|---|---|---|---|---|
| 6,195,896 | B1 * | 3/2001 | Ireland | B26B 5/005 30/2 |
| 6,233,830 | B1 | 5/2001 | Lamond | |
| 6,291,602 | B1 | 9/2001 | Koch et al. | |
| 6,349,473 | B1 | 2/2002 | Schmidt | |
| 6,367,154 | B2 | 4/2002 | Degabli | |
| 6,857,192 | B1 | 2/2005 | Summers | |
| 6,865,816 | B1 | 3/2005 | Zajdel | |
| 7,100,285 | B1 | 9/2006 | Huang | |
| 8,539,677 | B2 | 9/2013 | Strauss | |
| 8,701,295 | B2 * | 4/2014 | Clearman | B43M 7/007 30/294 |
| 8,857,064 | B2 | 10/2014 | Schmidt | |
| 10,093,027 | B2 | 10/2018 | Garavaglia | |
| 2004/0187314 | A1 | 9/2004 | Johnson | |
| 2005/0193566 | A1 | 9/2005 | Brown | |
| 2007/0209209 | A1 | 9/2007 | Johnson et al. | |
| 2010/0263219 | A1 | 10/2010 | Kempker | |
| 2013/0298409 | A1 | 11/2013 | Jacobs et al. | |
| 2014/0190018 | A1 * | 7/2014 | Segler | B26B 5/00 30/278 |
| 2014/0345146 | A1 | 11/2014 | Schekalla | |
| 2015/0298330 | A1 | 10/2015 | Chen | |
| 2017/0217029 | A1 * | 8/2017 | Jacobs | B23P 15/28 |

* cited by examiner

UTILITY KNIFE

CROSS REFERENCE TO RELATED APPLICATIONS

This application is a divisional of U.S. application Ser. No. 15/981,240 filed May 16, 2018, which in turn claims priority to U.S. Provisional Application No. 62/506,775, filed May 16, 2017, the disclosure of which is herein incorporated by reference in its entirety. This application is also a continuation-in-part of U.S. patent application Ser. No. 29/604,206 filed May 16, 2017, the disclosure of which is herein incorporated by reference in its entirety.

BACKGROUND OF THE INVENTION

The present disclosure relates generally to utility knives, more particularly to a utility knife having at least one cutting edge, and more particularly to a utility knife having at least one cutting edge accessible through at least one guide notch, wherein the utility knife is operable to cut sheets or pieces of material, remove packaging tape from packages, and/or other activities. A method of using and manufacturing the utility knife is also described.

Utility knives are generally used for many purposes, including but not limited to cutting sheets of material, opening packages, etc. However, many existing utility knife types have a cutting edge(s) of a blade exposed. Exposed cutting edges of existing utility knives have various disadvantages, including threat of injury to a user.

Non-limiting examples of existing utility knifes are described in U.S. Pat. Nos. 2,810,194; 6,195,896; and US Pub. Nos. 2004/0187314; 2007/0209209; 2010/0263219; 2013/0298409; 2014/0345146; and 2015/0298330, all of which are incorporated herein by reference.

In view of existing, known utility knives, there is a need for a utility knife which is adaptable for use in many applications, including but not limited to cutting sheets of material, in an easy to use manner while providing safety to a user from contact with one or more cutting edges of the blade, and which optionally includes an internal storage cavity for storage of one or more replacement blades.

SUMMARY OF THE INVENTION

The present disclosure relates to a utility knife and method for using the utility knife, wherein the utility knife has at least one cutting edge accessible through at least one guide notch, wherein the utility knife is operable to cut sheets of material, remove packaging tape from packages, and/or other activities.

In one non-limiting aspect of the present disclosure, there is provided a utility knife having a handle which includes a first handle part and a second handle part, each of the first handle and second handle having a first end, a second end, and an outer surface. A hinged connection arrangement connects the first and second handle parts adjacent the second ends thereof. An interior cavity is defined by an inner surface of the first and second handle parts. A head unit is attached to the first handle part adjacent the first end thereof and the head unit includes a blade support component. A blade is attached to the blade support component. The blade support component is adapted to orient the blade in perpendicular relation to a central axis A-A of the handle, and the first and second handle parts are configurable between a closed position and an open position.

In another and/or alternative non-limiting embodiment of the present disclosure, the interior cavity of the utility knife includes one or more surface projections configured to divide the interior cavity into more than one cavity.

In another and/or alternative non-limiting embodiment of the present disclosure, the interior cavity of the utility knife includes a storage cavity configured to store one or more replacement blades adapted to attach to the blade support component. The interior cavity can optionally further include a retaining arm attached to one of the inner surfaces of the first or second handle parts. The retaining arm is configured to exert a force on the one or more replacement blades stored in the storage cavity. The retaining arm can be attached to one of the inner surfaces of the first or second handle parts via a pivot point. Moreover, the retaining arm can include a finger tab at one end of the retaining arm.

In another and/or alternative non-limiting embodiment of the present disclosure, the utility knife includes one or more mating arrangements adapted to maintain the first and second handle parts in a closed position. The one or more mating arrangements can include a magnet disposed on the inner surface of the second handle part. The one or more mating arrangements can optionally include at least one surface projection disposed on the inner surface of the second handle part and a recess disposed on the inner surface of the first handle part.

In another and/or alternative non-limiting embodiment of the present disclosure, the outer surfaces of the first and second handle parts of the utility knife can optionally include one or more ribs and grooves.

In another and/or alternative non-limiting embodiment of the present disclosure, the first and second handle parts can optionally each include a recessed portion adapted to aid in configuring the first and second handle parts between the closed position and open position. In one non-limiting configuration, the first handle part can optionally include a recess extending at least partially into the first end of the first handle part, where the recess is adapted to receive at least a portion of the head unit. In such embodiment, the recess can include a connection arrangement adapted to mount the blade support to the first handle part.

In another and/or alternative non-limiting embodiment of the present disclosure, the blade support component of the head unit optionally includes a blade mounting portion and a body portion. In such an embodiment, the blade mounting portion is adapted to support at least a portion of the blade and the body portion is adapted to attach to the first handle part of the utility knife.

In another and/or alternative non-limiting embodiment of the present disclosure, the head unit of the utility knife can optionally include a first outer guide and a second outer guide fixed in opposing relation to one another. In such an embodiment, the first and second outer guides are adapted to support the blade adjacent an outside edge thereof and/or form a respective first guide notch and second guide notch.

In another and/or alternative non-limiting embodiment of the present disclosure, the utility knife optionally includes a resilient guide ring disposed adjacent the first end of the first handle part.

In another and/or alternative non-limiting embodiment of the present disclosure, there is provided a method for using a utility knife. The method includes the steps of providing a utility knife including a handle, a head unit attached to the handle and including at least one guide notch, and a blade attached to the head unit; moving the at least one guide notch toward an edge of a sheet of material; feeding the sheet of material into the at least one guide notch; and, pulling the sheet of material into contact with the blade and causing the cutting of the sheet of material.

In another and/or alternative non-limiting embodiment of the present disclosure, a utility knife is disclosed that includes a handle having a first handle part and a second handle part, each of the first handle and second handle parts having a first end, a second end, and an outer surface. A hinged connection arrangement is also included, which connects the first and second handle parts adjacent the second ends thereof. The first and second handle parts are rotatable about the hinged connection arrangement between a closed position and an open position. An interior cavity is defined by an inner surface of the first and second handle parts and the interior cavity includes a storage cavity configured to store one or more replacement blades. A head unit is attached to the first handle part adjacent the first end thereof and includes a blade support component. A blade is attached to the blade support component and has a cutting edge. A first and second outer guide are fixed on the blade support component in opposing relation to one another, with the first and second outer guides being adapted to support the blade adjacent an outside edge thereof and/or form a respective first guide notch and second guide notch.

One non-limiting object of the present disclosure is the provision of an improved utility knife.

Another and/or alternative non-limiting object of the present disclosure is the provision of a utility knife which is adaptable for use in many applications, including but not limited to cutting sheets of material.

Another and/or alternative non-limiting object of the present disclosure is the provision of a utility knife which is easy to use.

Another and/or alternative non-limiting object of the present disclosure is the provision of a utility knife which can be safely used by a user.

Another and/or alternative non-limiting object of the present disclosure is the provision of a utility knife which limits contact of the user with one or more cutting edges of the blade during the use of the utility knife.

Another and/or alternative non-limiting object of the present disclosure is the provision of a utility knife which includes an internal storage cavity for storage of one or more replacement blades.

Another and/or alternative non-limiting object of the present disclosure is the provision of a utility knife which includes a handle having a first handle part and a second handle part, wherein each of the first handle and second handle parts having a first end, a second end, and an outer surface; a hinged connection arrangement connecting the first and second handle parts adjacent the second ends thereof; an interior cavity defined by an inner surface of the first and second handle parts; a head unit attached to the first handle part adjacent the first end thereof, the head unit including a blade support component; and, a blade attached to the blade support component, wherein the blade support component is adapted to orient the blade in perpendicular relation to a central axis A-A of the handle, and wherein the first and second handle parts are configurable between a closed position and an open position.

Another and/or alternative non-limiting object of the present disclosure is the provision of a utility knife wherein the interior cavity comprises one or more surface projections configured to divide the interior cavity into more than one cavity.

Another and/or alternative non-limiting object of the present disclosure is the provision of a utility knife wherein the interior cavity comprises a storage cavity configured to store one or more replacement blades adapted to attach to the blade support component.

Another and/or alternative non-limiting object of the present disclosure is the provision of a utility knife wherein the interior cavity includes a retaining arm attached to one of the inner surfaces of the first or second handle parts, and wherein the retaining arm is configured to exert a force on the one or more replacement blades stored in the storage cavity.

Another and/or alternative non-limiting object of the present disclosure is the provision of a utility knife wherein the retaining arm is attached to one of the inner surfaces of the first or second handle parts via a pivot point.

Another and/or alternative non-limiting object of the present disclosure is the provision of a utility knife wherein the retaining arm includes a finger tab at one end thereof.

Another and/or alternative non-limiting object of the present disclosure is the provision of a utility knife which includes one or more mating arrangements adapted to maintain the first and second handle parts in the closed position.

Another and/or alternative non-limiting object of the present disclosure is the provision of a utility knife wherein the one or more mating arrangements includes a magnet disposed on the inner surface of the second handle part.

Another and/or alternative non-limiting object of the present disclosure is the provision of a utility knife wherein the one or more mating arrangements include at least one surface projection disposed on the inner surface of the second handle part and a recess disposed on the inner surface of the first handle part.

Another and/or alternative non-limiting object of the present disclosure is the provision of a utility knife wherein the outer surfaces of the first and second handle parts comprise one or more ribs and grooves.

Another and/or alternative non-limiting object of the present disclosure is the provision of a utility knife wherein the outer surfaces of the first and second handle parts each comprise a recessed portion adapted to aid in configuring the first and second handle parts between the closed position and open position.

Another and/or alternative non-limiting object of the present disclosure is the provision of a utility knife wherein the first handle part comprises a recess extending at least partially into the first end thereof, the recess adapted to receive at least a portion of the head unit.

Another and/or alternative non-limiting object of the present disclosure is the provision of a utility knife wherein the recess comprises a connection arrangement adapted to mount the blade support to the first handle part.

Another and/or alternative non-limiting object of the present disclosure is the provision of a utility knife wherein the blade support component of the head unit further comprises a blade mounting portion and a body portion.

Another and/or alternative non-limiting object of the present disclosure is the provision of a utility knife wherein the blade mounting portion is adapted to support at least a portion of the blade and the body portion is adapted to attach to the first handle part.

Another and/or alternative non-limiting object of the present disclosure is the provision of a utility knife wherein the head unit includes a first outer guide and a second outer guide fixed in opposing relation to one another.

Another and/or alternative non-limiting object of the present disclosure is the provision of a utility knife wherein the first and second outer guides are adapted to support the blade adjacent an outside edge thereof and/or form a respective first guide notch and second guide notch.

Another and/or alternative non-limiting object of the present disclosure is the pro provision visional of a utility knife which includes a resilient guide ring disposed adjacent the first end of the first handle part.

Another and/or alternative non-limiting object of the present disclosure is the provision of a method for using a utility knife, comprising: providing a utility knife including a handle, a head unit attached to the handle and including at least one guide notch, and a blade attached to the head unit; moving the at least one guide notch toward an edge of a sheet of material; feeding the sheet of material into the at least one guide notch; and, pulling the sheet of material into contact with the blade and causing the cutting of the sheet of material. Another and/or alternative non-limiting object of the present disclosure is the provision of a utility knife comprising: a handle including a first handle part and a second handle part, each of the first handle and second handle having a first end, a second end, and an outer surface; a hinged connection arrangement connecting the first and second handle parts adjacent the second ends thereof, the first and second handle parts being rotatable about the hinged connection arrangement between a closed position and an open position; an interior cavity defined by an inner surface of the first and second handle parts, the interior cavity including a storage cavity configured to store one or more replacement blades; a head unit attached to the first handle part adjacent the first end thereof, the head unit including a blade support component; a blade attached to the blade support component and having a cutting edge; and, a first outer guide and a second outer guide fixed on the blade support component in opposing relation to one another, the first and second outer guide adapted support the blade adjacent an outside edge thereof and/or form a respective first guide notch and second guide notch.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF A NON-LIMITING EMBODIMENT

Figure 1:
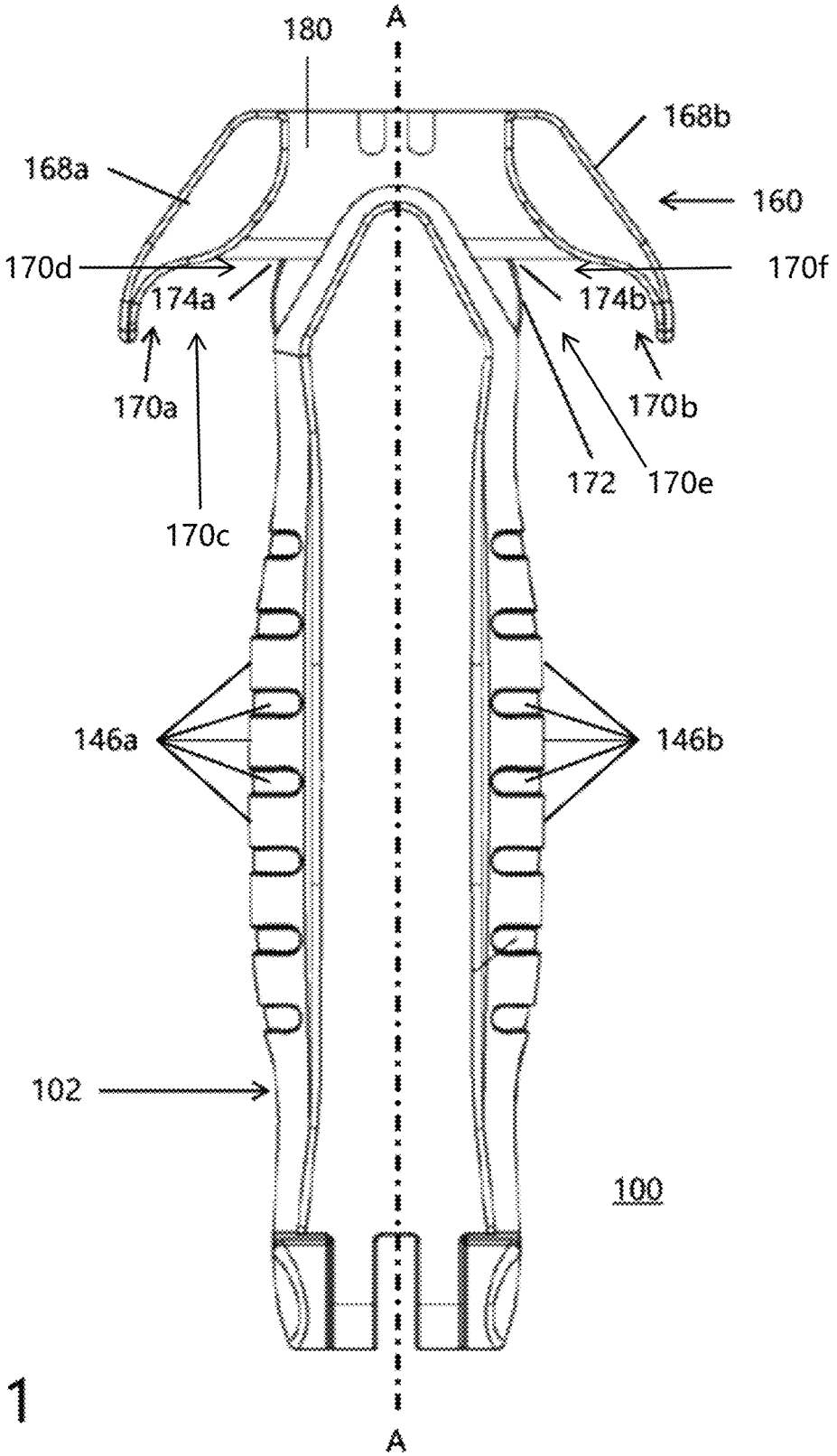
FIG. 1 is a top plan view of a utility knife in accordance with one non-limiting aspect of the present invention.
Figure 2:
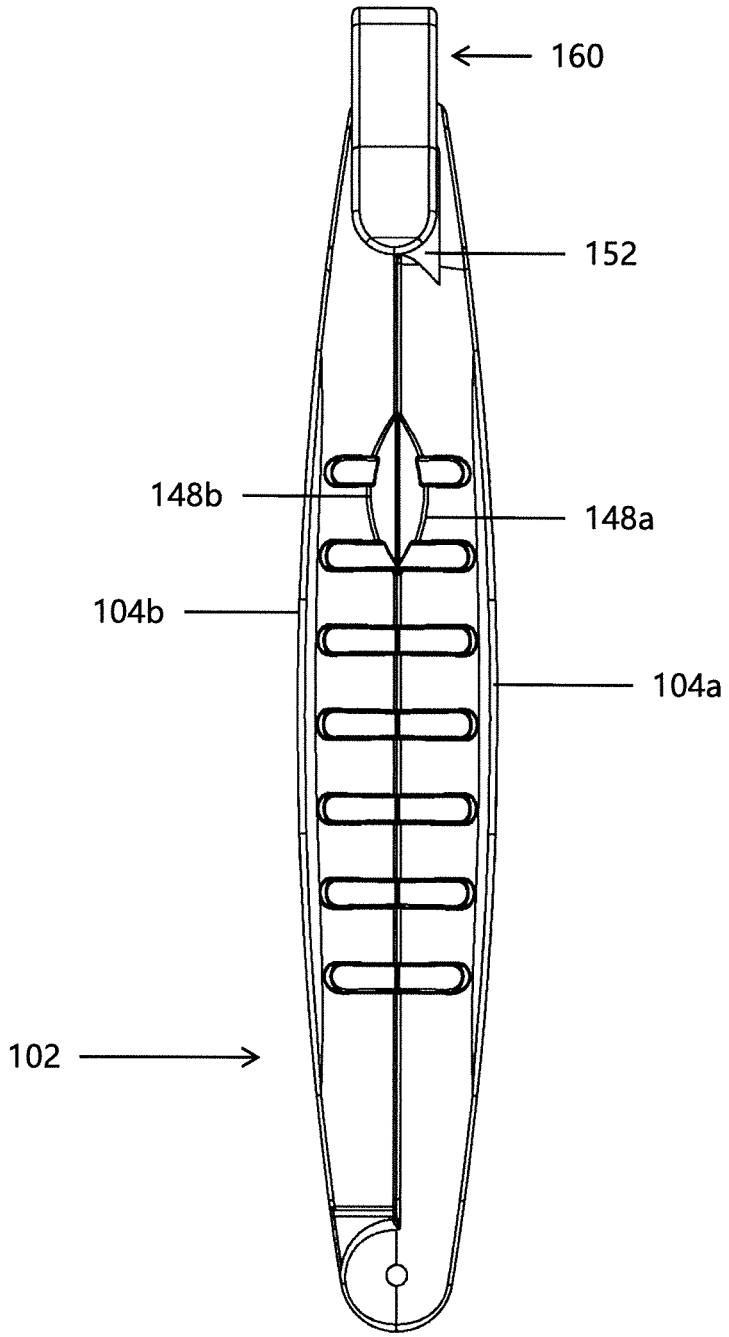
FIG. 2 is a side plan view of the utility knife of FIG. 1.

Referring now to the drawings, wherein the showings are for the purpose of illustrating various non-limiting embodiments of the disclosure only and not for the purpose of limiting the same, a utility knife suitable for use in cutting a piece of material (e.g., fiberboard material, paperboard material, cardboard material, plastic material, etc.) is disclosed herein.

The exemplary utility knife disclosed herein is specially adapted for use in cutting a sheet or piece of material. In operation, the material is moved through one or more guide notches and/or the one or more guide notches are moved through the material. A blade is securely fitted within the one or more guide notches such that a cutting edge of the blade is exposed. The material and/or one or more guide notches are forced against the exposed cutting edge of the blade, such as by a pulling action of a user, until the piece of material is cut to a desired degree. The presently disclosed utility knife is cost-efficient to manufacture, easy and safe to use, and can be used in a wide range of applications (e.g., cutting a sheet, layer, strip, membrane, adhesive, etc., or any desired piece of material). Although the utility knife of the present disclosure will be described primarily with reference to cutting a sheet of material, it can be appreciated that the utility knife of the present invention is amenable to other like applications.

Figure 5:
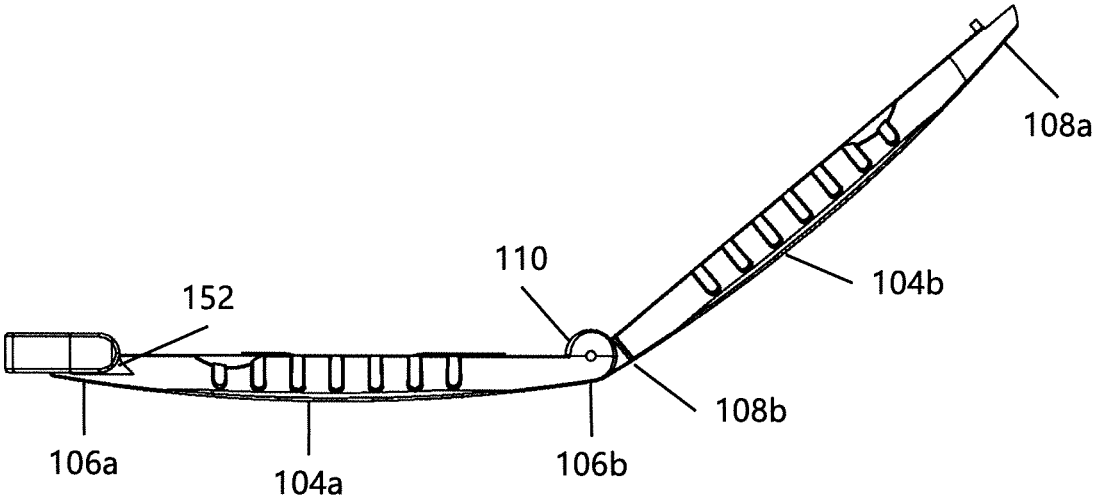
FIG. 5 is a side plan view of the utility knife of FIG. 1 showing the utility knife in an open configuration.
Figure 6:
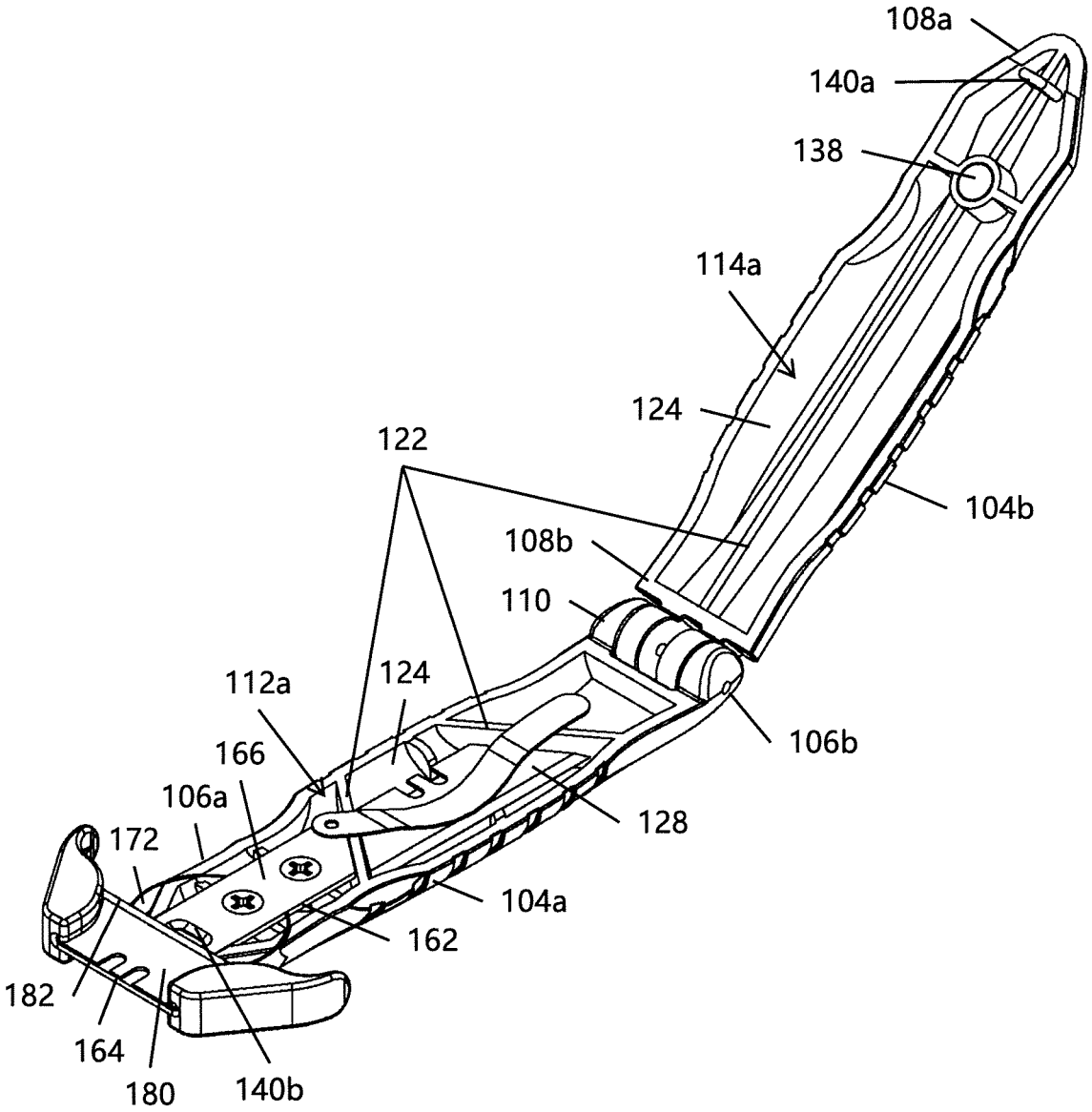
FIG. 6 is a top elevation view of the utility knife of FIG. 1 showing the utility knife in an open configuration; and, FIG. 7 is a top plan view of a utility knife of FIG. 1 showing the utility knife in an open configuration.
Figure 7:
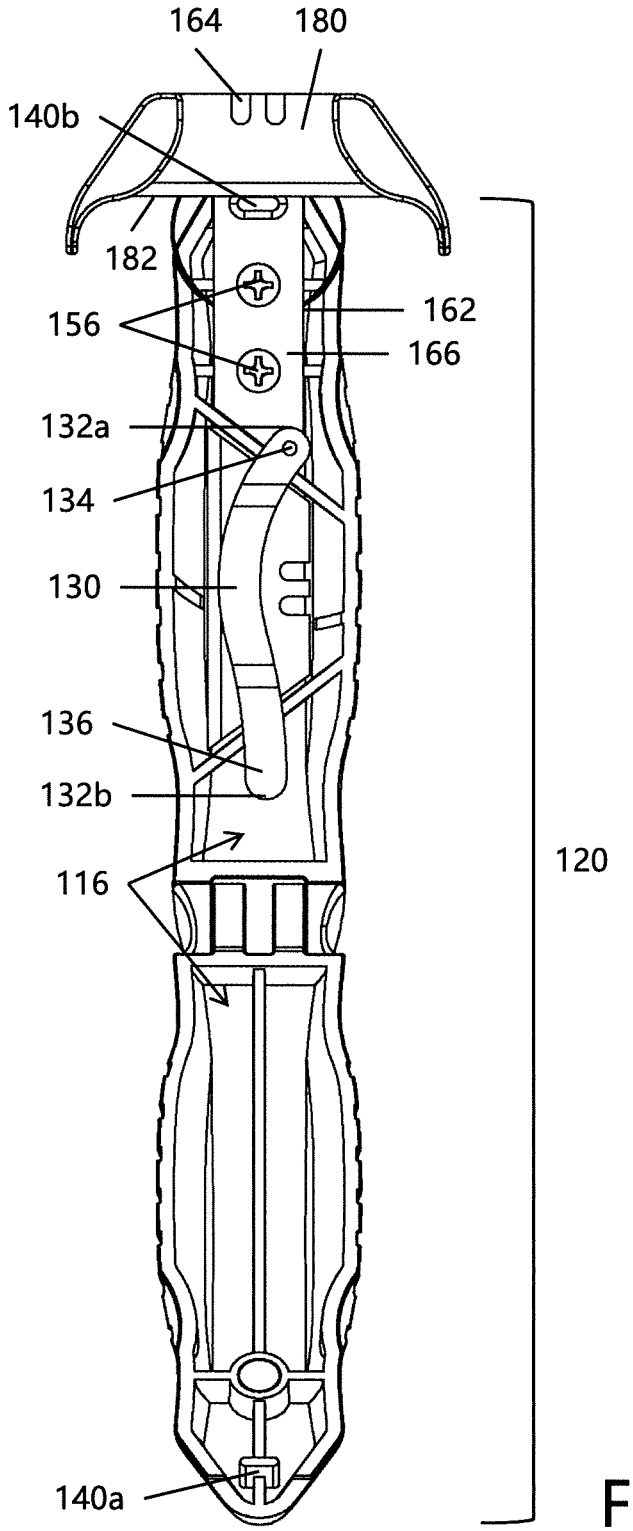

FIGS. 1-7 illustrate a non-limiting embodiment of a utility knife 100 in accordance with various aspects of the present disclosure. FIGS. 1-4 illustrate the utility knife 100 in a first, closed position, where a first handle part and a second handle part are disposed substantially against each other and are attached by a hinged connection arrangement. FIGS. 5-7 illustrate the utility knife 100 in a second, open position, where the hinged connection arrangement permits the first and second handle parts to be angled away from each other.

The exemplary utility knife 100 is generally composed of three (3) primary components, including a handle portion 102, a head unit 160 connectable to the handle portion, and a blade 180 connectable to the head unit. The handle portion includes a first part 104*a* and a second part 104*b*, with the first and second parts being rotatably connected to each other via connection arrangement 110. As can be appreciated, other connection arrangements can be used to connect together the first and second parts without departing from the present disclosure (e.g., snap connection, tongue and groove connection, sliding lock connection, etc.). The head unit includes a blade support 162 having a mount portion 164 and a body portion 166, and one or more outer guides 168*a*, 168*b* connected to the blade support. The one or more outer guides 168*a*, 168*b* at least partially define one or more guide notches 170*a*, 170*b* adapted to help feed a piece of material therethrough. The blade 180 has a cutting edge 182 adapted to sufficiently cut the material item.

Additional features of the handle 102 of utility knife 100 will now be described with reference to FIGS. 1-7. A central longitudinal axis A-A, as illustrated in FIG. 1, runs through the center of each part 104*a*, 104*b* of the handle 102. The first part 104*a* of the handle 102 includes a first end portion 106*a* and a second end portion 106*b* disposed along central longitudinal axis A-A. The second part 104*b* of the handle 102 also includes a first end portion 108*a* and a second end portion 108*b* disposed along central longitudinal axis A-A, with both second end portions 106*b*, 108*b* being disposed generally adjacent one another. In one non-limiting arrangement, the first end portion 106*a* of the first handle part 104*a* can include a connection arrangement (described in further detail below) for attachment of the head unit 160 to the handle portion 102. In another and/or alternative non-limiting arrangement, the second end portions 106*b*, 108*b* are provided with connection arrangement 110 (described in further detail below) for attachment of the first and second handle parts 104*a*, 104*b*, respectively. In another and/or alternative non-limiting aspect of the present disclosure, handle part 104*a* includes an inner surface 112*a* and an outer surface 112*b*, and handle part 104*b* similarly includes inner and outer surfaces 114*a*, 114*b*. Together, the inner surfaces 112*a* and 114*a* of handle parts 104*a* and 104*b* optionally form an interior hollow region or cavity 116 of the handle 102.

In one non-limiting aspect of the present disclosure, the connection arrangement 110 between the first and second handle parts 104*a*, 104*b* can be a hinged connection arrangement, thereby allowing the handle parts to be moved between at least a first and second position. For example, the handle can be moved from a first, closed position 118 (see FIGS. 1-4) where the two handle parts are disposed against one another, and a second, open position 120 (see FIGS. 5-7) where the two handle parts are oriented away from one another at an angle defined about the hinged connection arrangement 110. In this regard, the hinged connection arrangement 110 allows access to the interior portion 116 of the handle 102.

The size and/or shape of the handle 102 is non-limiting, and each handle part 104*a*, 104*b* can have the same or different size and/or shape without departing from the scope of the present disclosure. However, in one non-limiting arrangement, the first and second handle parts 104*a*, 104*b* can include a reduced thickness or width portion located at or generally adjacent to the first ends 106*a*, 108*a* thereof. Similarly, the first and second handle parts 104*a*, 104*b* can include another reduced thickness or width portion located at or generally adjacent to the second ends 106*b*, 108*b* thereof. In such a configuration, the thickest or widest portion of the handle 102 is optionally located at or near a middle portion thereof, and the first and/or second ends taper away from the thick middle portion toward central longitudinal axis A-A to form reduced thickness portions. In any event, the use of different thickness and/or width portions at different points along central longitudinal axis A-A of the handle of the utility knife advantageously provides an ergonomic feel when held by a user.

In another and/or alternative non-limiting aspect of the present disclosure, handle part 104*a* includes an inner surface 112*a* and an outer surface 112*b*, and handle part 104*b* similarly includes inner and outer surfaces 114*a*, 114*b*. Together, the inner surfaces 112*a* and 114*a* of handle parts 104*a* and 104*b* optionally form an interior hollow region or cavity 116 of the handle 102.

In another and/or alternative non-limiting aspect of the present disclosure, the inner surfaces 112*a* and 114*a* of handle parts 104*a* and 104*b* optionally provide a substantially hollow interior or cavity 116 when positioned together. The inner surfaces 112*a* and 114*a* can include one or more ridges and/or surface projections 122 configured to, for example, divide the internal region 116 into one or more separate internal cavities and/or provide structural strength to the knife. For example, in one non-limiting configuration, the one or more ridges and/or surface projections 122 form a first cavity 124 and a second cavity 126 in first handle part 104*a*. The first cavity 124 can be configured as a storage cavity for one or more replacement blades 128. The size and/or shape of the storage cavity 124 is non-limiting; however, the storage cavity is generally sized and shaped to match the shape of blade 180 and the one or more replacement blades 128. Generally, when more than one blade is stored in the storage cavity 124, the blades are stacked on top of one another.

In another and/or alternative non-limiting aspect of the present disclosure, the handle 102 includes a retaining arm 130 connected to an inner surface of the interior region 116 or to the head unit 160, for example. However, the mounting location for the retaining arm 130 is non-limiting. The retaining arm 130 generally includes a first end 132*a* and a second end 132*b*. In one non-limiting arrangement, a first end 132*a* of the retaining arm 130 is connected via a pivot point 134 so as to be rotatable between a plurality of positions. For example, the retaining arm 130 can be moved between a first position, where the retaining arm is disposed substantially above the storage cavity 124, and a second position, where the retaining arm is disposed over another portion of the interior region 116 of handle 102. In some embodiments, the retaining arm 130 can be bent and/or substantially biased in a curved configuration so as to exert a force on the top blade in the stack of the one or more replacement blades 128 stored in storage cavity 124. As such, the retaining arm is adapted to: i) prevent relative movement of one or more of the replacement blades 128 in storage cavity 124 when the handle 102 is in closed position 118, and/or ii) prevent the one or more replacement blades from falling out of the handle during opening thereof or in open position 120.

In another and/or alternative non-limiting arrangement of the present disclosure, the second end 132*b* of the retaining arm 130 extends at least partially above the second internal cavity 126 of the first handle part 104*a*. In such a configuration, the second internal cavity 126 is generally empty. In this regard, the second end 132*b* is adapted to be used as a finger tab 136 which a user can use to lift the retaining arm 130 and rotate it about pivot point 134 such that the bent/biased section of the retaining arm is no longer contacting the replacement blades 128. In other words, the finger tab 136 helps position the retaining arm 130 in a different location such that the one or more replacement blades 128 are easily accessible.

In another and/or alternative non-limiting aspect of the present disclosure, the exemplary utility knife 100 can include one or more mating arrangements adapted to maintain the first and second handle parts 104*a*, 104*b* in the closed position 118. In some embodiments, a magnet 138 can be disposed on the inner surface 114*a* of the second handle part 104*b* and located at or near the first end 108*a*. The magnet 138 is configured to interact with another component disposed on the inner surface 112*a* of the first handle part 104*a* (such as the blade support component 162 of the head unit 160 described in further detail below). In other words, the magnet 138 can be used to help maintain the first and second handle parts 104*a*, 104*b* in closed relation to one another. As can be appreciated, the magnet can be used with or substitute for other connection arrangements (e.g., hook and loop fastener, snap, etc.).

In another and/or alternative non-limiting aspect of the presently disclosed utility knife, in addition or alternatively to the magnet 138, the one or more mating arrangements adapted to maintain the first and second handle parts 104*a*, 104*b* in the closed position 118 includes at least one surface projection 140*a* and a corresponding recess 140*b*. The at least one surface projection 140*a* can be disposed on the inner surface 114*a* of the second handle part 104*b* and located at or near the first end 108*a*. The number of surface projections is non-limiting. The at least one surface projection 140*a* is configured to mechanically and/or physically interact with another component disposed on the inner surface 112*a* of the first handle part 104*a*. For example, in one non-limiting arrangement, the blade support 162 includes a cavity and/or recess 140*b* which is generally configured to mate with the at least one surface projection

140*a*. As such, the mating engagement of the surface projection 140*a* with the recess 140*b* at least partially maintains the closed position 118 of the first and second handle parts 104*a*, 104*b*.

Thus, the handle 102 of the utility knife 100 can be held in the closed position 118 by at least: i) the magnetic interaction between the magnet 138 of the second handle part 104*b* and the blade support component 162; ii) the mating engagement of the surface projection 140*a* on the second handle part 104*b* with the corresponding recess 140*b* on the blade support component 162; and/or iii) the physical force exerted on the opposing first and second handle parts 104*a*, 104*b* by a user holding the utility knife. As can be appreciated, other types of connection arrangements can be used (e.g., snap connection, hook and loop connection, latch connection, etc.).

Figure 3:
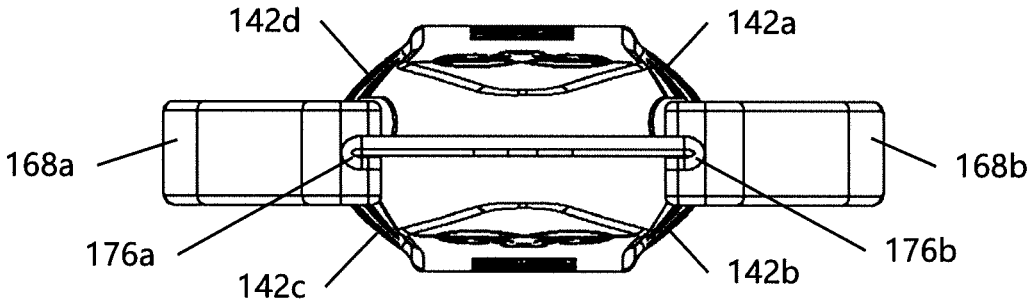
FIG. 3 is a front plan view of the utility knife of FIG. 1.
Figure 4:
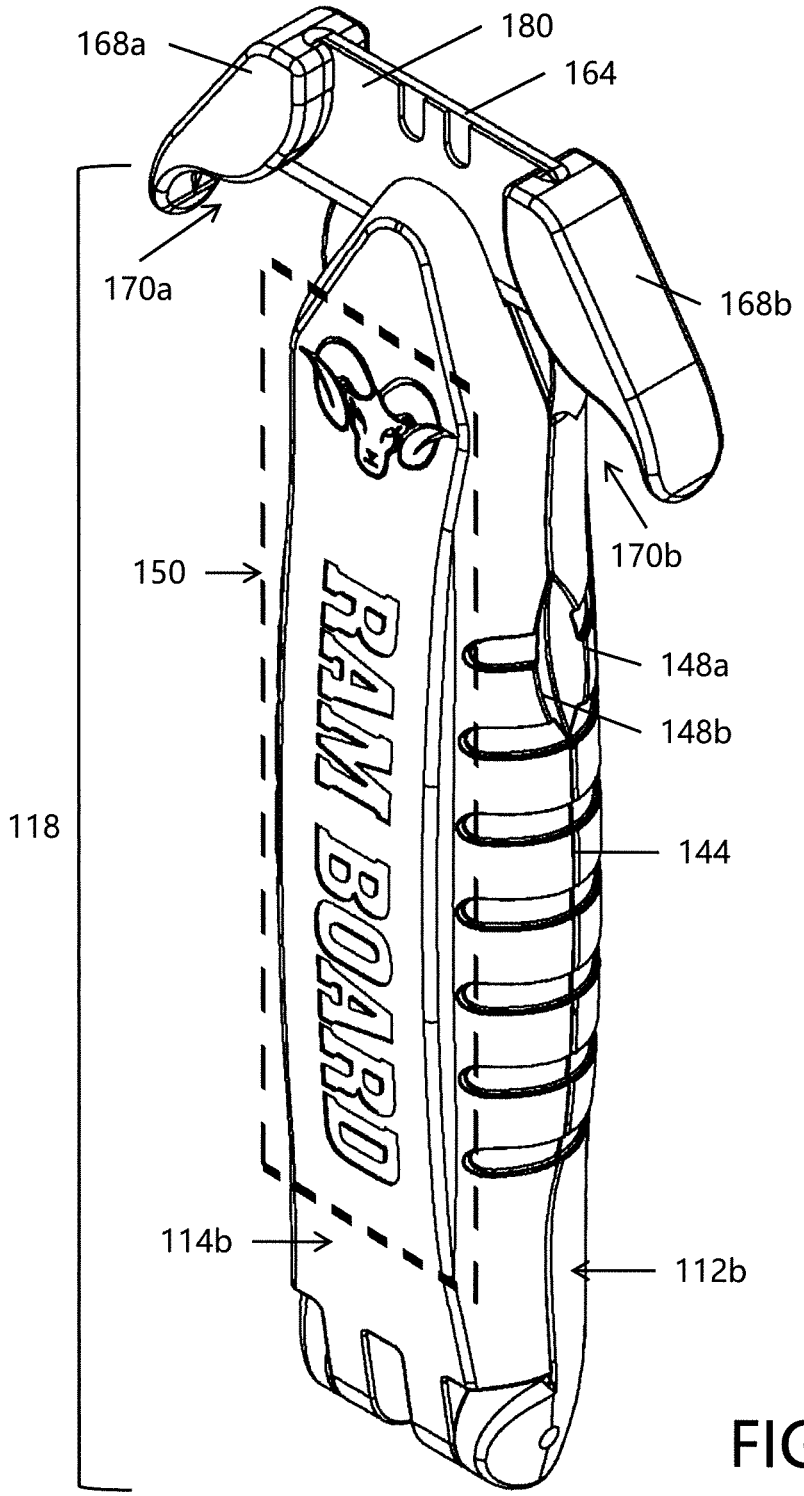
FIG. 4 is a side elevation plan view of the utility knife of FIG. 1.

In another and/or alternative non-limiting aspect of the present disclosure, the first and second parts 104*a*, 104*b* of the handle 102 have substantially curved edges 142*a*, 142*b*, 142*c*, and 142*d* (see FIG. 3). In such a configuration, when first and second handle parts 104*a*, 104*b* are in closed position 118, the edges 142*a*-142*d* form a continuous, substantially rounded profile 144 for the handle 102. The curved edges 142*a*-142*d* further add to the ergonomic feel of the handle 102 when a user holds the utility knife 100.

In another and/or alternative non-limiting aspect of the present disclosure, the outer surfaces 112*b*, 114*b* of the first and second handle part 104*a*, 104*b*, respectively, each include one or more ribs and/or grooves 146*a* and 146*b*. The ribs and/or grooves 146*a*, 146*b* on outer surfaces 112*b*, 114*b* are adapted to help a user grip the handle 102 during use of the utility knife 100. In one non-limiting configuration, where both the first and second handle parts 104*a*, 104*b* each include ribs and/or grooves 146*a*, 146*b*, the ribs and/or grooves of each handle part are configured to align substantially with one another when the utility knife is in the closed position 118. Additionally, the presence of ribs and/or grooves 146*a*, 146*b* on the utility knife handle allow a user to exert increased force when employing the utility knife in difficult cutting situations, such as cutting thicker sheets of material, for example. In this regard, ribs and/or grooves 146*a*, 146*b* provide a first safety mechanism adapted to help prevent a user's hand from contacting the exposed cutting edge 182 of blade 180. As can be appreciated, other types of gripping arrangements can also or alternatively be used (e.g., plastic or polymer material, rough surface, sticky surface, adhesive, slots, etc.).

In another and/or alternative non-limiting aspect of the present disclosure, the outer surfaces 112*b*, 114*b* of the first and second handle parts 104*a*, 104*b* each include a recessed portion 148*a* and 148*b*, respectively. Recessed portions 148*a*, 148*b* are adapted to provide a user with a feature on the handle 102 that permits separation of the handle parts, such that the hand can easily and conveniently be opened about hinged connection 110. In one non-limiting configuration where both the first and second handle parts 104*a*, 104*b* include a recessed portion 148*a* and 148*b*, the recessed portions of each handle part are configured to align with one another when the handle is in the closed position 118. In another and/or alternative non-limiting configuration, the recessed portions are located at or near the first ends 106*a*, 108*a* of the handle parts (i.e., opposite connection arrangement 110). As can be appreciated, other types of gripping arrangements can also or alternatively be used (e.g., plastic or polymer material, rough surface, sticky surface, adhesive, slots, etc.).

In another and/or alternative non-limiting aspect of the present disclosure, the outer surfaces 112*b*, 114*b* of the first and second handle parts 104*a*, 104*b* can include a design 150 (e.g., logo, symbol, lettering [e.g., brand name], etc.). The design 150 can be engraved or embossed into the handle 102. As can be appreciated, the design 150 could also be applied to the outside surfaces 112*b*, 114*b* via an adhesive product, such as a sticker, for example.

In another and/or alternative non-limiting aspect of the present disclosure, the first handle part 104*a* includes a recess 152 extending at least partially into the first end 106*a* thereof. The recess 152 generally extends along the longitudinal axis A-A on the first handle part 104*a* and is generally disposed on the inner surface 112*a* thereof. In some particular, non-limiting embodiments, the length of the recess 152 is from about 10% to about 50% (and all values and ranges therebetween) the length of the first handle part 104*a*. The recess 152 is adapted to permit at least partial connection of the head unit 160 to the handle 102 of the utility knife 100. For example, the recess 152 can be configured to provide a surface to which the body portion 166 of the blade support 162 is attached. In such a configuration, the recess 152 includes a connection arrangement (not shown) adapted to mount the blade support 162 to the first handle part 104*a*. For example, the connection arrangement of the recess 152 can include one or more threaded cavities (not shown) configured to receive one or more fasteners 154, such that the head unit 160 can be securely fastened to the handle 102 of the utility knife 100. As can be appreciated, the head unit can be connected to the first handle part by other or alternative arrangements (e.g., adhesives, snaps, pins, etc.).

Additional features of the head unit 160 of exemplary utility knife 100 will now be described with reference to FIGS. 1-7. According to another and/or alternative non-limiting aspect of the present disclosure, the head unit 160 is generally attachable to and removable from the first ends 106*a*, 108*a* of the first and second handle parts 104*a*, 104*b*, respectively. When the head unit 160 is connected to the handle 102, both the head unit and the handle are in central alignment with the longitudinal axis A-A. In addition, the head unit 160 is configured to receive the at least one blade 180 and securely hold the blade in place when the utility knife is in operation.

In another and/or alternative non-limiting aspect of the present disclosure, the head unit 160 of the utility knife 100 further includes a blade support component 162. The blade support 162 generally includes a blade mount portion 164 and a body portion 166. In one non-limiting arrangement, the body portion 166 extends at least partially into the handle 102 (i.e., into the recess 152) for attachment thereto, while the mount portion 164 is adapted to support at least a portion of the blade 180.

In another and/or alternative non-limiting aspect of the present disclosure, the head unit also includes a pair of oppositely disposed outer guides 168*a*, 168*b*. The outer guides 168*a*, 168*b* are generally fixedly mounted to opposite ends of the mount portion 164 of the head unit 160. In one non-limiting arrangement, the outer guides 168*a*, 168*b* are adapted to: i) provide support at or near the outside edges of the blade 180, and/or ii) form a respective guide notch 170*a*, 170*b* which each define a perimeter through which a sheet of material can be moved. The outer guides 168*a*, 168*b* generally have a length greater than that of the blade 180 in order to define an outer extent for guide notches 170*a*, 170*b* and to form a barrier/protect against accidental contact with the exposed cutting edge 182 of the blade 180. The inclusion of one or more guide notches (e.g., two guide notches 170*a*, 170*b*) permits the utility knife to be held in different positions to expose the material being cut to a different portion of the cutting edge 182 of the blade 180. The size of the guide notches can have a variable width. As illustrated in FIG. 1, the width of the guide notch at the entrance or front end (170*c*, 170*e*) of the guide notch is greater than the width of the guide notch at the back end (170*d*, 170*f*) (e.g., location of the tip of the blade). In one non-limiting arrangement, the width of the front end of one or both guide notches is 10-200% (and all values and ranges therebetween) greater than the backend width of one or both guide notches. In one particular configuration, the width of the front end of one or both guide notches is at least 25% greater than the backend width of one or both guide notches.

The size of each guide notch is non-limiting. In embodiments where the utility knife includes two guide notches, the size of each guide notch can be the same or different without departing from the scope of the disclosure. Generally, the width of the guide notch is selected so as to prevent unintentional contact with the cutting edge, such as by a user that might be injured by accidental contact with the exposed cutting edge of the blade. As such, if an object (e.g., finger, sheet of material, foreign object, etc.) has a width greater than the width of the guide notch, the object will not fit into the guide notch, thereby preventing injury to a user or damage to the object. In one non-limiting configuration of the invention, the size or width of one or both of the two guide notches is 0.1-1 inches (and all values and ranges therebetween).

Accordingly, the one or more guide notches provide a second safety mechanism to prevent a user from being injured by the cutting edge of the blade in addition to the first safety mechanism described above mechanism (i.e., the ribs and/or grooves on the handle portion). In other words, if the first safety mechanism fails and a user's hand slides towards the cutting edge of the blade, the second safety mechanism may prevent contact between the user's hand and the exposed blade edge.

In another and/or alternative non-limiting aspect of the present disclosure, the exemplary utility knife 100 can further optionally include a resilient guide ring 172 generally disposed adjacent the first end 106*a* of the first handle part 104*a*. The resilient guide ring 172 forms inner guides 174*a*, 174*b* of the guide notches 170*a*, 170*b*, respectively, which are adapted to flexibly apply pressure to a piece of material as it enters into one of guide notches 170*a*, 170*b* and toward the cutting edge 182 of blade 180. The material used to form the guide ring is non-limiting, but generally includes resilient materials such as metal, composite material, or plastic. The application of pressure to the sheet of material being moved through the inner guides 174*a*, 174*b* helps to prevent the material from bending, folding, or creasing as the sheet of material contacts the cutting edge 182 of the blade 180.

In another and/or alternative non-limiting aspect of the present disclosure, each guide notch 170*a*, 170*b* can include a gap and/or space 176*a* 176*b* configured to allow at least a portion of the blade 180 to be inserted therein. As such, the outer guides 168*a*, 168*b* are further adapted to aid in at least partially retaining the blade 180 held by the head unit 160 of the utility knife. The blade generally includes at least one cutting edge 182. However, as can be appreciated, the blade can include any number of edges for other or alternative purposes (e.g., prying, scraping, scratching, etc.). Generally, the blade 180 is attached to the head unit 160 of the utility knife 100 such that the at least one cutting edge 182 is disposed toward the handle 102.

In one non-limiting aspect of the present disclosure, when the handle 102 is in the open position 120, the blade 180 can slide into the head unit 160 of the utility knife. The blade 180 is at least partially retained by the outer guides 168*a*, 168*b*. When the handle 102 is moved to its closed position 118, the surface projection 140*a* of the second handle part 104*b* engages the recess 140*a* in the body portion 166 of the blade support component 162, thereby retaining the blade 180 in the head unit 160. In addition, if the magnet 138 is used, when the handle 102 is moved to its closed position 118, the magnet attracts to the body portion 166 of the blade support component 162, thereby further aiding in the securement of the blade 180 within the head unit 160. Accordingly, when the utility knife is in the closed position 118, the blade is at least partially retained therein by: (1) first outer guide 168*a*; (2) second outer guide 168*b*; (3) the mating engagement of the surface projection 140*a* with the recess 140*b*; and/or (4) the magnetic engagement of the magnet 138 with the body portion 166 of the blade support component 162.

The material of the blade 180 is non-limiting. Generally, the blade can be made from steel as is typically known in the art; however, other or alternative blade types can be used (e.g., metal blades, plastic blades, ceramic blades, etc.) without departing from the scope of the present disclosure. The size and/or shape of the blade 180 is also non-limiting. In one non-limiting arrangement, the blade is trapezoidal in shape; however, other or alternative shape blades can be used. In another and/or alternative non-limiting arrangement, the thickness of the blade is between about 0.02 mm and about 2 mm, more particularly between about 0.1 mm and about 0.8 mm. However, the thickness of the blade is non-limiting. The cutting edge 182 of the blade can be linear or non-linear and the blade 180 can optionally include one or more holes, apertures and/or cutouts designed to allow the blade to be releasably secured to the utility knife. Non-limiting examples of blades which can be used in conjunction with the utility knife of the present invention are described at least in U.S. Pat. No. 8,291,602 and US 2004/0187314, which are incorporated herein by reference.

In another and/or alternative non-limiting aspect of the present disclosure, when the blade 180 is connected to the head unit 160 of the utility knife 100 of the present disclosure, the cutting edge of the blade is provided approximately perpendicular (e.g., about 85°-95°) to the longitudinal axis A-A. However, it can be appreciated that the cutting edge of the blade can be provided at other or alternative angles (e.g., about 45° to about 135° and all values and ranges therebetween) relative to the longitudinal axis A-A of the utility knife, without departing from the scope of the present disclosure.

In another and/or alternative non-limiting aspect of the present disclosure, the utility knife 100 can be manufactured and/or formed from separate components. The separate components can be formed from the same or different types of material without departing from the scope of the present disclosure. For example, in one non-limiting configuration, the handle 102 of the utility knife can be formed from plastic and the head unit 160 can be formed from metal. As can be appreciated, the handle 102 and head unit 160 can alternatively be formed from the same material. In another and/or alternative non-limiting aspect of the present disclosure, the material used to form most of the components of the utility knife is a metal or metal alloy material. Metal or metal alloy material provides sufficient rigidity and durability for using the utility knife, particularly in heavy-duty applications. As can be appreciated, however, one or more components of the utility knife can be formed from other or alternative materials (e.g., plastic, ceramic, carbon fiber etc.).

In known utility knifes, the blade is often over-molded with a plastic material. Such known utility knifes are thus often only suitable for "one-time-use" and/or are designed to be disposable, since the blade cannot be removed or separated from the knife. For example, once the blade becomes damaged or dull from excessive use, the utility knife is no longer usable. The unique configuration of the utility knife of the present disclosure allows the blade to be removed and replaced such that the utility knife can be used as many times as desired.

Furthermore, the material used to make known utility knives is often plastic. Plastic materials, while cost-efficient, are subject to breakage or damage when excessive force is applied to the utility knife such as, for example, when attempting to cut a thick piece of material. The unique configuration of the utility knife of the present disclosure provides a utility knife formed of metal and/or steel, thereby providing a "heavy-duty" utility knife.

In another and/or alternative non-limiting aspect of the present disclosure, there is provided a method for using the presently described utility knife. In use, a user holding the utility knife of the present invention may employ the utility knife such that, initially, a guide notch of the utility knife is moved towards an edge of a sheet of material to be cut. Through use of a general pulling motion, the sheet of material to be cut can be fed into either of the guide notches of the utility knife. In addition, or alternatively, the guide notches can be pulled through the sheet of material. Continuing the general pulling motion, the sheet of material to be cut is continuously fed into the guide notches and is caused to move into contact with the cutting edge of the blade. As such, by further continuing the pulling motion, the material can be continuously cut.

As described above, the cutting edge the blade of the utility knife can initially be oriented at or near an edge of a sheet of material to be cut, such that a cutting action can be initiated by moving the utility knife in a first direction such as, for example, towards the sheet of material. Generally, the first direction is a direction toward the user; however, this is not required. As can be appreciated, the pulling direction can be away from the user. In one non-limiting aspect of the present disclosure, when a user is employing the presently disclosed utility knife, the utility knife is held such that the longitudinal axis A-A of the utility knife aligns with a longitudinal cutting axis of the material. For example, the utility knife can be used at about a 45° angle relative to the sheet of material to be cut. As can be appreciated, other angles can be used without departing from the scope of the present disclosure.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed:

1. A method for using a utility knife, comprising:

providing a utility knife including a handle having a first handle part which has a first end and a second end, a head unit attached to the handle and including a first guide notch, a blade attached to the head unit, and a first resilient and flexible guide disposed adjacent the first end of the first handle part; said handle includes a second handle part, said second handle part having a first end and a second end; said first and second handle parts each having an outer surface; said first and second handle parts connected at or adjacent to said second ends by a connection arrangement to enable said first and second handle parts to move between open and closed positions; inner surfaces of said first and second handle parts forming an interior cavity when said first and second handle parts are positioned adjacent to one another in said closed position; said head unit includes a blade support component; said blade is attached to said blade support component; said blade support component configured to orient said blade in a perpendicular relation to a central axis of said handle; said head unit is attached to said first handle part at or adjacent to said first end of said first handle part; said blade support component including first and second outer guides fixed in opposing relation to one another; a first guide notch formed between at least a portion of said outer first guide and at least a portion of said first handle part; a second guide notch formed between at least a portion of said outer second guide and at least a portion of said first handle; said first and second guide notches each having a front entrance and a back end; said blade removably attached to said blade support component; said front entrances of said first and second guide notches each having a width that is greater that a width of said back end of said first and second guide notches; a majority of a longitudinal length of said first and second guide notches having a greater width than said back end of said first and second guide notches; said first resilient and flexible guide at least partially positioned in said first guide notch;

moving the first guide notch toward an edge of a sheet of material;

feeding the sheet of material into the first guide notch; and, pulling the sheet of material into contact with the blade and causing the cutting of the sheet of material.

2. The method as defined in claim 1, wherein said width of said front entrance of said first and second guide notches is at least 25% greater than said width of the back end of the first and second guide notches, a majority of said width of said first and second guide notches between said front entrance and said back end is greater than said width at said back end of said first and second guide notches.

3. The method as defined in claim 2, wherein said first and second guide notches have first and second sides that are non-parallel to one another along a majority of a longitudinal length of said first and second guide notches.

4. The method as defined in claim 1, wherein said first resilient and flexible guide having an arcuate shape along a majority of a length of said first resilient and flexible guide, said first resilient and flexible guide only connected to one of said first and second handle parts.

5. A method for using a utility knife, comprising:

providing a utility knife including a handle having a first handle part which has a first end and a second end, a head unit attached to the handle and including a first guide notch, a blade attached to the head unit, and a first resilient and flexible guide disposed adjacent the first end of the first handle part; said handle includes a second handle part, said second handle part having a first end and a second end; said first and second handle parts each having an outer surface; said first and second handle parts connected at or adjacent to said second ends by a connection arrangement to enable said first and second handle parts to move between open and closed positions; inner surfaces of said first and second handle parts forming an interior cavity when said first and second handle parts are positioned adjacent to one another in said closed position; said head unit includes a blade support component; said blade is attached to said blade support component; said blade support component configured to orient said blade in a perpendicular relation to a central axis of said handle; said connection arrangement includes a hinge arrangement; said handle including a magnet disposed at or adjacent to said first ends of at least one of said first and second handle parts; said first and second handle parts being rotatable about said hinge arrangement between said open position and said closed position; said magnet configured to releasably secure said first and second handle parts in said closed position; said head unit is attached to said first handle part at or adjacent to said first end of said first handle part; said blade support component including first and second outer guides fixed in opposing relation to one another; a first guide notch formed between at least a portion of said outer first guide and at least a portion of said first handle part; a second guide notch formed between at least a portion of said outer second guide and at least a portion of said first handle part; said first and second guide notches each having a front entrance and a back end; said blade removably attached to said blade support component; said front entrances of said first and second guide notches each having a width that is greater that a width of said back end of said first and second guide notches; a majority of a longitudinal length of said first and second guide notches having a greater width than said back end of said first and second guide notches; said first resilient and flexible guide at least partially positioned in said first guide notch;

moving the first guide notch toward an edge of a sheet of material;

feeding the sheet of material into the first guide notch; and, pulling the sheet of material into contact with the blade and causing the cutting of the sheet of material.

6. The method as defined in claim 5, wherein said width of said front entrance of said first and second guide notches is at least 25% greater than said width of the back end of the first and second guide notches, a majority of said width of said first and second guide notches between said front entrance and said back end is greater than said width at said back end of said first and second guide notches.

7. A method for using a utility knife, comprising:

providing a utility knife including a handle having a first handle part which has a first end and a second end, a head unit attached to the handle and including a first guide notch, a blade attached to the head unit, and a first resilient and flexible guide disposed adjacent the first end of the first handle part; said handle includes a second handle part; said second handle part having a first end and a second end; said first and second handle parts each having an outer surface; said first and second handle parts connected at or adjacent to said second ends by a connection arrangement to enable said first and second handle parts to move between open and closed positions; inner surfaces of said first and second handle parts forming an interior cavity when said first and second handle parts are positioned adjacent to one another in said closed position; said head unit includes a blade support component; said blade is attached to said blade support component; said blade support component configured to orient said blade in a perpendicular relation to a central axis of said handle; said interior cavity comprises one or more cavity projections configured to divide said interior cavity into a plurality of sub-cavities; one of said sub-cavities forming a storage cavity for storing a plurality of replacement blades; said storage cavity including a retaining arm that is attached to one of the inner surfaces of said first or second handle parts; said retaining arm is configured to exert a force on one or more of said replacement blades stored in said storage cavity to maintain the plurality of replacement blades located in said interior cavity;

said connection arrangement includes a hinge arrangement; said handle including a magnet disposed at or adjacent to said first ends of at least one of said first and second handle parts; said first and second handle parts being rotatable about said hinge arrangement between said open position and said closed position, said magnet configured to releasably secure said first and second handle parts in said closed position; a mating arrangement is located on said first and second handle parts, said mating arrangement on said second handle part includes a mating projection on said inner surface of said second handle part, said mating arrangement on said first handle part includes a recess on the inner surface of said first handle part, said mating projection configured to enter said recess when said first and second handle parts are in said closed position; said head unit is attached to said first handle part at or adjacent to said first end of said first handle part; said blade support component including first and second outer guides fixed in opposing relation to one another; a first guide notch formed between at least a portion of said outer first guide and at least a portion of said first handle part; a second guide notch formed between at least a portion of said outer second guide and at least a portion of said first handle part; said first and second guide notches each having a front entrance and a back end; said blade removably attached to said blade support component; said front entrances of said first and second guide notches each having a width that is greater that a width of said back end of said first and second guide notches; a majority of a longitudinal length of said first and second guide notches having a greater width than said back end of said first and second guide notches; said first resilient and flexible guide at least partially positioned in said first guide notch;

moving the first guide notch toward an edge of a sheet of material;

feeding the sheet of material into the first guide notch; and, pulling the sheet of material into contact with the blade and causing the cutting of the sheet of material.

8. The method as defined in claim 7, wherein said width of said front entrance of said first and second guide notches is at least 25% greater than said width of the back end of the first and second guide notches, a majority of said width of said first and second guide notches between said front entrance and said back end is greater than said width at said back end of said first and second guide notches.

9. The method as defined in claim 8, wherein said first resilient and flexible guide having an arcuate shape along a majority of a length of said first resilient and flexible guide, said first resilient and flexible guide only connected to one of said first and second handle parts.

* * * * *